73-151.5
2/11/86 XR 4,570,234

United States Patent [19]

Baack

[11] Patent Number: 4,570,234

[45] Date of Patent: Feb. 11, 1986

[54] OILFIELD MONITOR AND RECORDER

[76] Inventor: Richard A. Baack, 3016 Yucca Rd., Weatherford, Tex. 76086

[21] Appl. No.: 385,899

[22] Filed: Jul. 23, 1982

[51] Int. Cl.[4] ..... E21B 47/00; G06F 15/46

[52] U.S. Cl. ..... 364/550; 73/151.5; 346/33 WL

[58] Field of Search ..... 73/151.5; 346/33 W, 346/49, 33 WL; 364/420, 422, 570, 571, 550, 551, 132, 400; 340/853–861; 367/25, 35; 175/25, 40; 166/66, 250

[56] References Cited

U.S. PATENT DOCUMENTS

| | | | |
|---|---|---|---|
| 3,541,852 | 11/1970 | Brown et al. | 73/151.5 |
| 3,785,202 | 1/1974 | Kelseaux et al. | 73/151.5 |
| 3,876,016 | 4/1975 | Stinson | 73/151.5 |
| 3,906,437 | 9/1975 | Brandwein et al. | 364/511 |
| 3,982,432 | 9/1976 | Hammond | 364/422 |
| 4,055,763 | 10/1977 | Antkiw | 364/422 |
| 4,145,744 | 3/1979 | Sidorovich et al. | 364/551 |
| 4,157,659 | 6/1979 | Murdock | 364/422 |
| 4,310,887 | 1/1982 | Suau | 340/853 |
| 4,350,979 | 9/1982 | Eberwein | 364/422 |
| 4,352,166 | 9/1982 | Schoonover | 346/33 WL |
| 4,393,485 | 7/1983 | Redden | 175/40 |
| 4,432,064 | 2/1984 | Barker et al. | 364/422 |

*Primary Examiner*—Felix D. Gruber
*Assistant Examiner*—Heather R. Herndon

[57] ABSTRACT

An oilfield monitor and recorder system providing marker positioning using a leadscrew, a stepper motor, a position sensor, driver and control. The control provides zero, span, slew and range functions. The rate input scaling provides calibration, percent, sum to monitor and sum to recorder controls. The pressure input scaling provides zero, span and calibration controls, therefore the input signals are calibrated and scaled for presentation to display and marker control circuits. Record advancement uses tractor drives, stepper motor, precision time base, driver and control in order to provide an accurate time record relationship. This portable battery powered system and apparatus is housed in a briefcase size enclosure. The electrical signals obtained from a plurality of physical conditions are processed, recorded and displayed on respective recorder and display channels, which particularly meets the oilfield stimulation service industry requirements for a portable monitoring and recording apparatus.

16 Claims, 10 Drawing Figures

FIG. 6 GRAND TOTAL
FIG. 6 TOTAL
FIG. 2 SIG. COND.
FIG. 4 CONTROL/ DRIVE
FIG. 5 TIMEBASE DRIVE
FIG. 6 RATE

CAL FACTOR SWITCHES (PUL/GAL)
TOTAL A SELECT SWITCH
B TOTAL SIGNAL
THRESHOLD ADJUST
INPUT SIGNAL B2
PERCENT (%) SWITCHES
RATE A SELECT SWITCH
B RATE SIGNAL

RECORD SPEED ✳
DIVISIONS/MINUTE
X3 INCHES/HOUR
JUMPER
A to B
A to C

PLL
VCO OUT
VCO IN
PC2 OUT
PC_A
PC_B
C/A
C/B
BIN
0-15
RECORD SPEED
DEC
CTL_A
CTL_B
PE OUT
COUNTER / DECODER
CL INH
DIVIDE 2^12
Q12
Q11
Q8
INH
DRIVE
ON
OFF
FAST FORWARD
MOM
DIRECTION
OSC/DIVIDER
2 HZ OUTPUT
2K HZ
70 HZ
BUF OSC
GATE
ENABLE
LATCH ENABLE
STROBE
RESET
STEPPER MOTOR
ALIGN ROD
TRACTOR DRIVE
RECORD

OILFIELD MONITOR AND RECORDER

BACKGROUND OF THE INVENTION

The oilfield stimulation services industry has a requirement to monitor and provide a permanent record of the operating parameters when performing services ( i.e. fracturing, acidizing, cementing ). Certain known apparatus to position the marking means using drive wires, pulleys, A.C. or D.C. motors, resistive element position sensors, analog drive and control means. These systems do not meet the requirements of a oilfield environment due to mechanical and electrical shortcomings ( i.e. failure of drive wires, resistive element position sensors, etc. ), accuracy of measurements varies excessively ( i.e. 3%, 5%, 10%, or more ), in particular the resistive position sensor becomes contaiminated and worn which causes instability and oscillation of the marker, rendering the record useless. Another major problem with certain known apparatus is making the monitor display the same value as the recorded data. A resistive element connected to the marker drive apparatus, commonly known as a retransmitting slide wire, suffers from the problems associated with resistive position sensors, in addition the retransmitted signal inaccuracy is compounded by the mechanical coupling arrangement and becomes useless should the marker drive apparatus fails for any reason thus rendering the recorder and monitor display channel useless. The need for a 115 VAC power source or an inverter/converter along with excessive power demands, large physical size, heavy weight, and/or fragility of standard recorders and monitors limits their use for application in a oilfield environment and in portable applications.

SUMMARY OF THE INVENTION

The present invention relates to systems and apparatus for monitoring and/or recording data in a oilfield environment to meet stimulation services industry requirements. An arrangement for display of multiple parameters by means of a visual display and a chart marking apparatus while maintaining accuracy thru extreme temperature, humidity, vibration, chemical exposure, and physical abuse. The present invention has a unique marker apparatus which utilizes a leadscrew to insure marker drive reliability. A precision timebase maintains accuracy thru extreme temperatures, humidity, and/or vibration. Non-contact means sense marker position to insure long term reliable operation under adverse conditions. The timebase and input signals are common to the recorder and monitor display which insures the same readings at all times thus eliminating calculations and manipulation of numbers by the operator in order to calibrate the system. Also the number of controls are greatly reduced by the unique marker apparatus which simplifies operation, increases reliability, and reduces errors. Operation from a single low voltage power supply, prescaling of input signal, compact light weight drive apparatus, unique marker apparatus and record advance means make possible portable operation in an oilfield environment.

It is, therefore, an objective of the present invention to provide a new and improved oilfield monitor and recorder system and apparatus wherein a dynamic display and a chart marker means provide monitoring of job progress ( i.e. fracturing service being performed ) and a permanent record of parameter time relationship. The parameter time relationship is extremely important because charges for services rendered are determined by hydralic horsepower (HHP), HHP=RATE×PRESSURE / 40.8, and the total volume delivered which determine the length of time the HHP must be sustained, hence parameter recording errors of less than plus or minus one percent (1%) are considered acceptable.

It is a further objective of the present invention to provide a new and improved oilfield monitor and recorder system and apparatus wherein the accuracy and reliability requirements are acheived thur the use of a leadscrew and/or non-contact position sensor in combination with a stepper motor.

It is a still further objective of the present invention to provide a new and improved oilfield monitor and recorded system and apparatus wherein a means is provided to prescale the input signal for application to the dynamic display and recorder control means. A common timebase signal is utilized by the recorder and monitor display to insure the same reading at all times and since the monitor display signal is not derived from the marker drive a failure of a recorder channel does not disable the associated monitor display. In addition calibration of each channel is independent of the other which reduces the number of operator controls, simplifies operation and calibration, thus providing a improved monitoring and recording system and apparatus for the oilfield stimulation service industry.

DESCRIPTION OF THE DRAWINGS

FIGS. 2,3,4,5 and 6 when positioned as shown in FIG. 2*a* comprise a schematic diagram of a typical rate channel of the apparatus of FIG. 1;

FIG. 3 is a schematic diagram of typical circuitry that may be used to perform the function of prescaling voltage/frequency converter of voltage signal inputs of the apparatus of FIG. 1;

FIGS. 3,4,5 and 6 when positioned as shown in FIG. 3*a* comprise a schematic diagram of a typical pressure channel of the apparatus of FIG. 1;

FIG. 4 is a schematic diagram of typical logic circuitry that may be used to perform the function of the pen control/select and stepper motor control/drive of the apparatus of FIG. 1;

FIG. 5 is a schematic diagram of typical logic circuitry that may be used to perform the function of the timebase oscillator generator and chart motor control/driver of the apparatus of FIG. 1;

FIG. 5*a* shows the effect of jumper (302) connections; and

FIG. 6 is a schematic diagram of typical logic circuitry that may be used to perform the function of the grand totalizer, totalizer, rate and pressure displays of the apparatus of FIG. 1.

DESCRIPTION OF THE PREFERRED EMBODIMENT

Figure 1:
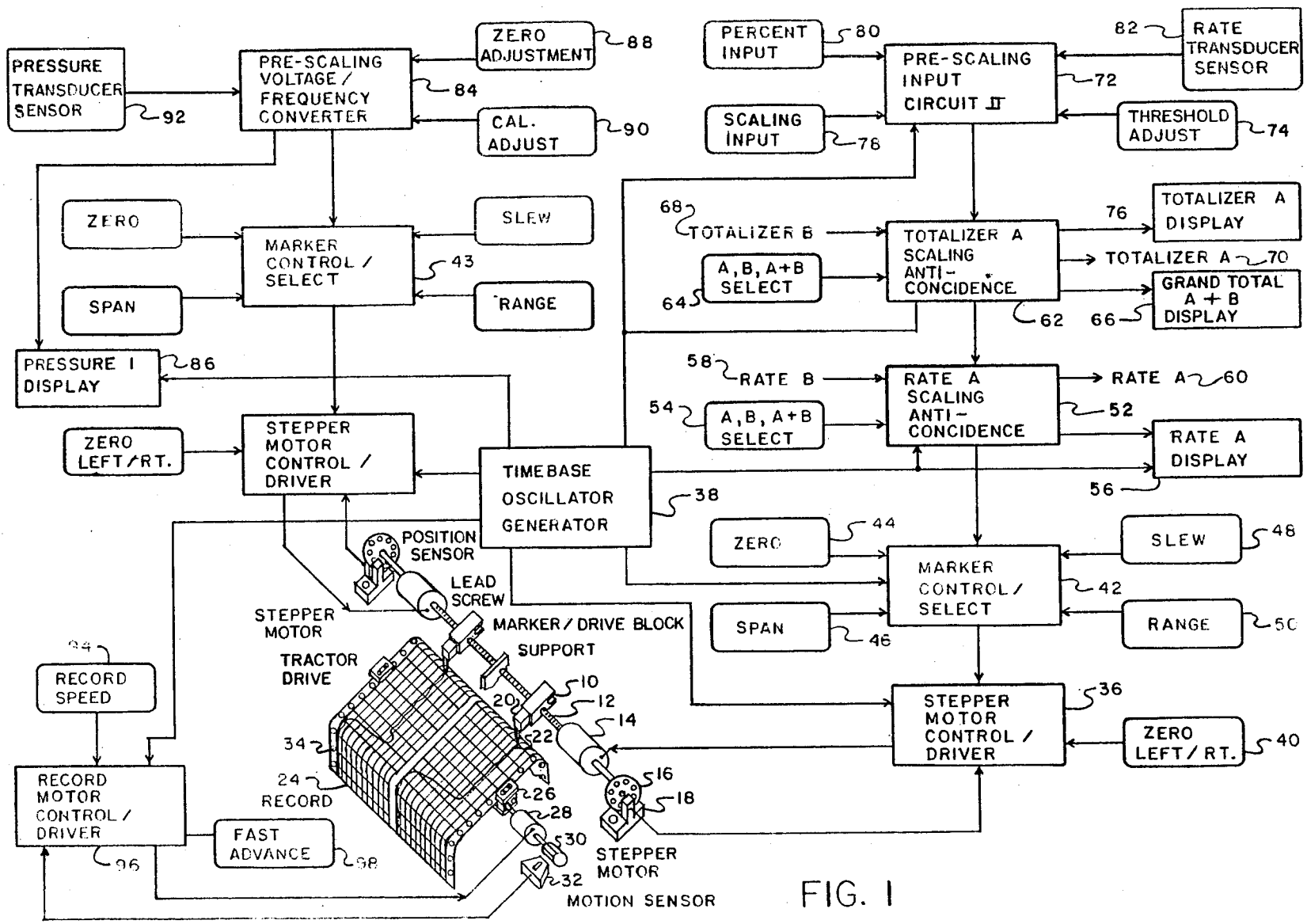
FIG. 1 is a block diagram showing one embodiment of a oilfield monitor and recorder apparatus of the present invention.

Referring now to the drawings and more particularly to FIG. 1 thereof, the present invention is therein illustrated as comprising three main parts; the recorder, which provides the permanent record of the process parameters; the monitor, which provides a digital display of the process parameters on a real time basis and allows viewing by multiple persons; and the input circuitry, which provides the necessary prescaling and/or scaling of input signals for presentation to the recorder and/or monitor sections. The recorder portion can be more easily understood by further subdivision into mechanical and electrical assemblies; the mechanical assembly having two parts; the marker drive and position assembly; and the record drive aassembly; the electrical portion having three sections, namely; stepper motor driver and position control; the pen control and range select; and the chart motor control/driver. The monitor portion consist of universal display units and apparatus, whose input signal sources determines the parameters displayed whether rate, totalizer, grandtotal, pressure, density, concentration, or rpm is the parameter being monitored. The input circuitry is also more easily understood by further subdivision into four sections, namely; rate scaling anti-coincidence; totalizer scaling anti-coincidence; prescaling input circuit; prescaling voltage/frequency converter. The timebase circuit is common to recorder, monitor and input circuitry.

The marker drive and position assembly consist of a marker/driver block 10 which is driven by rotation of leadscrew 12 coupled to stepper motor 14 which is connected to interrupter disc 16 whose rotation is sensed by opto interrupter 18. The leadscrew 12 has preferably twenty four threads per inch and stepper motor 14 has preferably forty-five degree steps, this combination gives two hundredth of an inch movement of marker 20 for each step of motor 14 which is small enough to appear as an analog movement and the line 22 drawn on record 24 appears analog.

The record drive assembly consist of two tractor drive units 26 which are driven by stepper motor 28 which is connected to interrupter 30 whose rotation is sensed by photo emitter detector 32. The tractor drive 26 aligns and holds record 24 thru engagement of sprocket holes 34 thus insuring proper positioning, holding and advancement of record 24.

The stepper motor control/drive 36 accepts input signals from; timebase oscillator generator 38; zero left/right switch 40, which permits marker 20's zero or home position to be on the left or right of the record zone 24; marker control/select 42; and opto interrupter 18, which senses rotation of motor 14 and leadscrew 12; and performs the necessary comparison of input signal to marker position signal and generates a output drive signal to stepper motor 14, thus providing for closed loop marker positioning.

The marker control/select 42, 43 accepts input signals from; timebase oscillator generator 38; zero switch 44, which is used to set the initial zero or home position of marker 20 by the operator; span potentiometer 46, which is used by the operator to set the full scale position of marker 20; slew potentiometer 48, controls the rate at which marker 20 is permitted to move giving the effect of dampening marker 20 movement; range select switch 50, allows the operator to select the full scale range of the marker in addition to providing zero and span calibration of the marker; and rate scaling anti-coincidence 52 or prescaling voltage/frequency converter 84 would supply the input signal depending on whether the channel is a rate or pressure channel respectively. These signals are conditioned for application to stepper motor control/drive 36, thus providing adjustment of marker zero, span ( full scale ), marker slew rate ( dampening ), and full scale range which can be changed during operation with out adjustment or loss of calibration.

The chart motor control/driver 96 accepts input signals from; timebase oscillator generator 38; chart speed switch 94, which is used to set the divisions per unit of time at which the record 24 is advanced; and fast advance switch 98, which the operator uses too advance the record rapidly for loading or to remove a completed record. The input signals are combined to generate a precision timed output signal for driving stepper motor 28, thus providing an accurate parameter time relationship with less than 0.01% error.

The display monitors 56, 66, 76 and 86 accept input signals from their respective signal sources, rate scaling anti-concidence 52, totalizer scaling anti-coincidence 62, and prescaling voltage/frequency converter 84; also rate display 56 and pressure display 86 use timebase signals to derive the displayed parameters. These display units are universal and can be used for remote display applications or to display other parameters such as rpm, density, concentration, or mixing ratios, thus providing a real time dynamic display for monitoring parameters and displaying them to multiple persons.

The rate scaling anti-coincidence 52 accepts input signals from; totalizer A scaling anti-coincidence 62; rate B signal 58; and A, B, A+B select switch 54, which allows the operator to output to recorder rate A channel and monitor rate A display, the A rate signal only or the B rate signal only or the sum of the A plus B rate signals. These signals are used to generate the output signal; rate A output signal 60, which is used by the B rate channel; rate A display signal, which is used by rate A display 56; and recorder rate A channel signal, which is used by marker control/select 42, thus front panel controls are provided to configure the rate portion for varing job requirements.

The totalizer scaling anti-coincidence 62 accepts input signals from; prescaling input circuits 72; totalizer B signal 68; and A, B, A+B select switch 64, which allows the operator to output to totalizer A display the A total signal only or the B total signal only or the sum of the A plus B total signals. These input signals are used to generate the output signals; totalizer A output signal 70, which is used by B totalizer channel; totalizer A display signal, which is used by totalizer A display 76; grandtotal signal, which is used by grandtotal display 66; and rate A signal, which is used by rate A scaling anti-coincidence 52, thus front panel controls are provided to configure the monitor's totalizer portion for multiple stage jobs.

The prescaling input circuit 72 accepts input signals from; rate transducer sensor 82, which could be any frequency source such as magnetic pickup, tach-generator, hall effect sensor, or opto sensor; threshold adjust 74, which sets the hysteresis for maximum noise immunity; scaling input thumb wheel switch 78, which provides a means for the operator to enter the events per unit of measure; and percent input thumbwheel switch 80, which provides the operator a means to change the input rate by a calibrated percentage (i.e. a turbine flow meter has a calibration factor for water, when a gel fluid is pumped thru the turbine the cal factor drops due to the fluid characteristics, the percent function can be used to compensate for this drop). The output signal of the prescaler 72 is applied to totalizer A scaling anti-coincidence 62, thus front panel controls are provided to scale and calibrate a frequency signal with a minimum of complexity and controls.

The prescaling voltage/frequency converter 84 accepts input signals from; pressure transducer sensor 92, which could be any voltage source such as a differential output pressure transducer, D.C. generator, potentiometer transducer, or current loop signal wit appropiate value sense resistor; zero adjustment 88, which allows the operator to compensate for drift or error in the transducer's zero output; cal adjustment 90; which allows the operator to compensate for drift or error in the transducer's full scale calibration. The two output signals of the prescaler 84 are applied to the pressure 1 display 86 of the monitor portion and to marker control/select 43 of pressure channel 1 of the recorder portion, thus front panel controls are provided to scale and calibrate a voltage signal with a minimum of complexity and controls.

The timebase oscillator generator 38 uses a crystal to maintain better than 0.005% stability. The oscillator signal is used to derive all other timing signals, which insures maximum stability of all displayed and recorded parameters. The timebase 38 also generates calibration signals for use in setting initial calibration of the monitor and recorder portions by the operator prior to each job, thus eliminating the need for generators, tuning forks, or other signal sources when performing initial calibration.

It should be noted that although only one rate channel and one pressure channel has thus far been described that typically a oilfield monitor and recorder for the stimulation industry would contain two rate and two pressure channels, two totalizers, and one grand totalizer. Also the apparatus as described in the preferred embodiment is not limited in the number of channels which could be incorporated nor in the type of parameters which are monitored and/or recorded, for example density could be monitored and recorded as an additional parameter.

Refering now to FIGS. 2, 3, 4, 5, and 6 wherein the detailed circuitry for the above described oilfield monitor and recorder of the present invention is shown. The rate transducer/sensor 82 provides an output frequency proportional to the flow rate being monitored. This signal is supplied through a voltage protection network including the series capacitor 102 and resistor 104 and shunt zener diode 106 to one input of the comparator 108. In order to accommodate different types of signals and/or signal sources, a threshold potentiometer 74 is arranged to provide an adjustable hysteresis for improved input noise immunity.

The cal factor switch 78A, 78B, and 78C provide a means of entering the events per unit of measure and preferably have a range of 0–159.9. The switch 78A, 78B, 78C are connected to a three and one half decade divider comprised of counters 118, 120, and 122 respectively. This provides a simple means of calibrating the system, so that signal sources having different calibration factors may be accommodated in accordance with the present invention. The output of comparator 108 is supplied to the clock input of counter 118.

The output signal of the divider comprised of counter 118, 120, and 122 is one event per unit of measure and is supplied to the phase comparator A input of phase lock loop 124.

The percent switches 80A and 80B provide a means of adjusting the rate by a calibrated percent and preferably have a range of 0–150%. The switches 80A and 80B are connected to a two and one half decade divider comprised of BCD counter 130 and Bin counter 132 respectively. The output of counter 132 is supplied to comparator B input of phase lock loop 124. The VCO output of phase lock loop 124 is supplied to the clock input of counter 130 and to the run terminal of cal/run switch 134.

The cal/run switch 134 provides a means of suppling a calibration signal to the rate channel for initial testing and calibration prior to operation. The common terminal signal of cal/run switch 134 is supplied to the ON terminal of the ON/OFF switch 136.

The ON/OFF switch 136 provides a means of disabling the rate signal. The off therminal is grounded and the common terminal signal of the ON/OFF switch 134 is supplied to a clock input of counter 138, which is arranged to divide by seven. The output signal of counter 138 is supplied to the clock input of counter 140 and to the comparator A input of phase lock loop 162. The counter 140 is arranged to divide by six and the output signal is supplied to the clock input of flip-flop 142.

The flip-flop 142 provides temporary storage of events. The output is supplied to a input of nand-gate 144, a input being a timing signal whose frequency is twice the maximum event frequency. When an event is stored in flip-flop 142 and a timing pulse occures nand-gate 144 develops an output which is supplied through a differential network consisting of series capacitor 146 and shunt resistor 148 to the reset input of flip-flop 142 clearing the event, and also supplied to a input of or-gate 150 and through a resistor 156 to a input of nand-gate 154. The timing signals prevent A and B totalizer signals from occuring simulataneously, therefore the pulse rates are summed or added together.

The input signals to nand-gate 154 are controled by totalizer A select switch 64, which determines whether the output signal of nand-gate 154 is total A signal, total B signal, or the sum of A plus B total signals. The signal developed by nand-gate 154 is supplied to totalizer 1 input of the monitor section, and provides resolution to the nearest tenth of a unit of measure. The output signal from or-gate 150 is supplied to the clock input of divide by ten counter 160, and whose output is supplied to the grand totalizer input of the monitor section and provides resolution to the nearest whole unit of measure.

The phase lock loop 162 and counter 164, 166, and 168 are arranged to provide a fixed multiply for use by the rate A channel of the recorder and the rate A display of the monitor portion of the system and apparatus of the present invention. The output is supplied to the clock input of flip-flop 170 which in combination with nand-gate 172, capacitor 174, resistor 176, 178, and 180, and nand-gate 182, forms an anti-coincidence circuit as heretofore described. The input signals to nand-gate 182 are controlled by rate A select switch 54, which determines whether the output is rate A signal, rate B signal, or the sum of A plus B rate signals.

The pressure transducer/sensor 92 provides an output voltage proportional to the hydralic pressure being monitored. This signal is supplied through an integration network including the series resistors 186, 188, and the shunt capacitors 190 and 194, and shunt resistors 192 and 196 to the input of differential amplifier 198. The output of amplifier 198 is supplied through an integration network consisting of series resistor 200 and shunt capacitor 202 to the comparator input of voltage to frequency converter 204. In order too accommodate transducers with different full scale ranges, a range switch 206 is arranged to provide different hertz per volt scaling. The prefered converter 204 used a current pulse and integration network comparison technique, making it possible to perform the zero compensation and full scale calibration at the converter 204 which limits interaction between zero and full scale adjustment (cal). The zero error is compensated by the voltage developed at the arm of zero potentiometer 88 and supplied through series resistor 210 and an integration network including shunt capacitor 212 and resistor 214 to the threshold input of the converter 204. The full scale adjustment is provided by the cal potentiometer 90, whose output is supplied to the current reference input of converter 204.

The cal switch 218 provides a signal to the calibration input of transducer 92, which outputs a full scale signal for initial calibration and testing. The transducer power switch 220 supplies power to the pressure transducer 92. The pressure transducer/sensor 92 is preferably a bonded strain gage type 507 made by Viatran Corporation.

The output of converter 204 is supplied to the clock input of decade counter 222 and the pressure 1 display input of the monitor section of the present invention. The output of counter 222 is a divide by five signal, which is supplied to the pressure 1 channel of the recorder section of the present invention.

Figures 4, 4A:
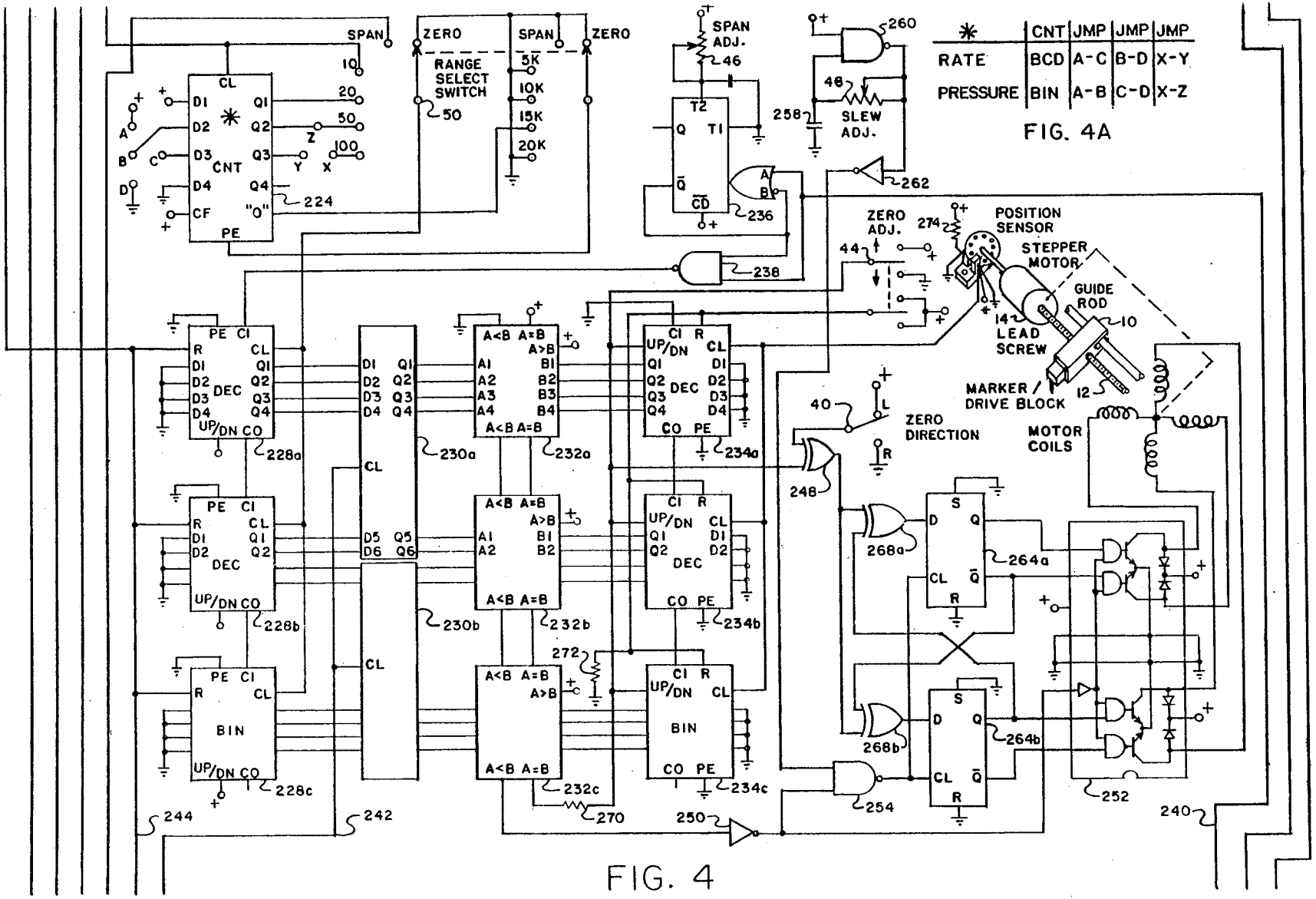

The input signal to counter 224 and range select switch 50 is either the output of nand-gate 182 or counter 222 depending on whether the channel is a rate or a pressure channel respectively. The counter 224 is arranged to provide scaled values to range select switch 50, and whose value is determined by the arrangement of jumpers as shown in FIG. 4A. When configured for a rate channel, counter 224 is a decimal and for a pressure channel is a binary counter. The output signal at the arm of switch 50 is suppplied to the clock input of counter 228A.

The arrangement of counter 228A,B,C, provides a three and one half decade counter whose output is supplied to the data inputs of latches 230A,B. The precision one shot 236 is triggered by gate signal 240 and whose output is supplied to nand-gate 238. The time period of one shot 236 is controlled by span adjust potentiometer 46. The output of nand-gate 238 is the difference between the pulse width of gate signal 240 and the pulse width of one shot 236, which is supplied to the control input of counter 228A. The span adjust potentiometer 46 controls the time period in which counter 228 accumulates input pulses. The number of pulses accumulated is representative of the input parameter's magnitude, hence the required position of marker 20. The accumulated count of counter 228 is latched at the end of gate signal 240 by strobe signal 242 into latch 230, then counter 228 is reset by reset signal 244 and is ready to accumulate new data.

In accordance with the present invention, the output of opto interrupter 18 is supplied to the clock input of counter 234, whose data value is representative of the actual position of marker 20. The output of counters 234A,B,C are supplied to the B input of comparator 232A,B,C and the output of latch 230 is supplied to the A input of comparator 232. The comparator 232 compares the magnitude of the data in latch 230 and counter 234 to determine which is greater A or B respectively, and outputs a signal through resistor 270 to the up/-down input of counter 234. If A is greater than B, Counter 234 counts up and if A is less than B, counter 234 counts down. The A equals B output of comparator 232 is supplied through inverter 250 to the enable input of motor drive 252 and nand-gate 254. When A equals B the clock and driver of stepper motor 14 is disabled thus saving power.

The slew adjust potentiometer 48 in combination with capacitor 258 and schmitt nand-gate 260 form a oscillator whose output signal is supplied through inverter 262 to the input of nand-gate 254. The output of nand-gate 254 is used to clock the stepper motor, hence controlling the slew rate of the stepper motor 14 and providing a dampening effect.

The zero direction switch 40 privides polarity control of the direction signal. When switch 40 supplies a ground to exclusive or-gate 248, the direction signal is only buffered, and when a positive signal is supplied to gate 248, the direction signal is inverted. The output of gate 248 is supplied to a input of exclusive or-gate 268A,B which provide sequence control of the flip-flop 264A,B. The flip-flops 264 provide sequence signals to the input of stepper motor driver 252. The output of exclusive or-gate 268A,B are supplied to the D inputs of flip-flops 264A,B respectively. The output of nand-gate 254 is supplied to the clock input of flip-flops 264A,B. This arrangement provides the sequence to drive the stepper motor 14 clockwise or counter clockwise.

The zero position switch 44 is used to set the initial position of the marker and resets counter 234, thus establishing a reference point from which the marker 20 will be advanced until the position data equals the input parameter data. This arrangement provides for closed loop positioning of the marker.

The cryatal 278 in conjunction with oscillator divider 280 generate the 2 KHZ and 70 HZ calibration signals and 2 Hz timing signal. The 2 Hz output of divider 280 is supplied to the clock inhibit input of counter/decoder 282, which remains reset until the occurence of the 2 HZ signal enables the clock input. The oscillator comprised of schmitt nand-gate 284, resistor 286, and capacitor 288 provides a output signal to the clock input of counter 282 and the clock input of counter/decoder 290. Counter 282 advances with the input enabled, which disables the gate output 240, and generates a strobe output 242 one clock pulse later, followed by reset output 244 another clock pulse later, thus providing non-overlaping strobe and reset pulses. The following clock pulse resets the counter 282 and the oscillator/divider 280, which clears the 2 HZ output, hence disables the clock input to counter 282 which remains reset. The output of counter/decoder 290 provides the timing signals for the anti-coincidence circuits. The buffer output of oscillator 280 is supplied to the clock input of a counter 292.

Figures 5, 5A:
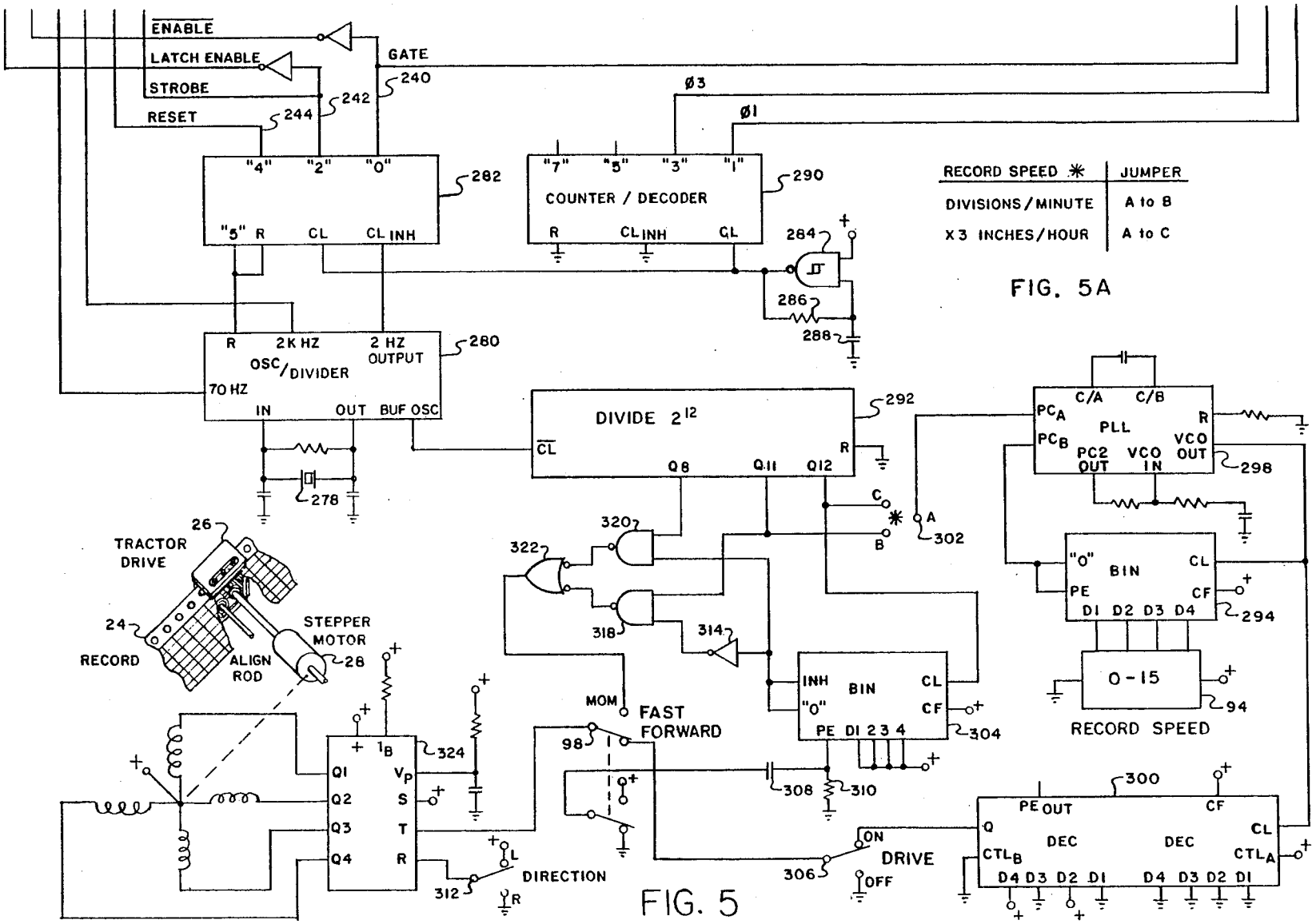
Figure 6:
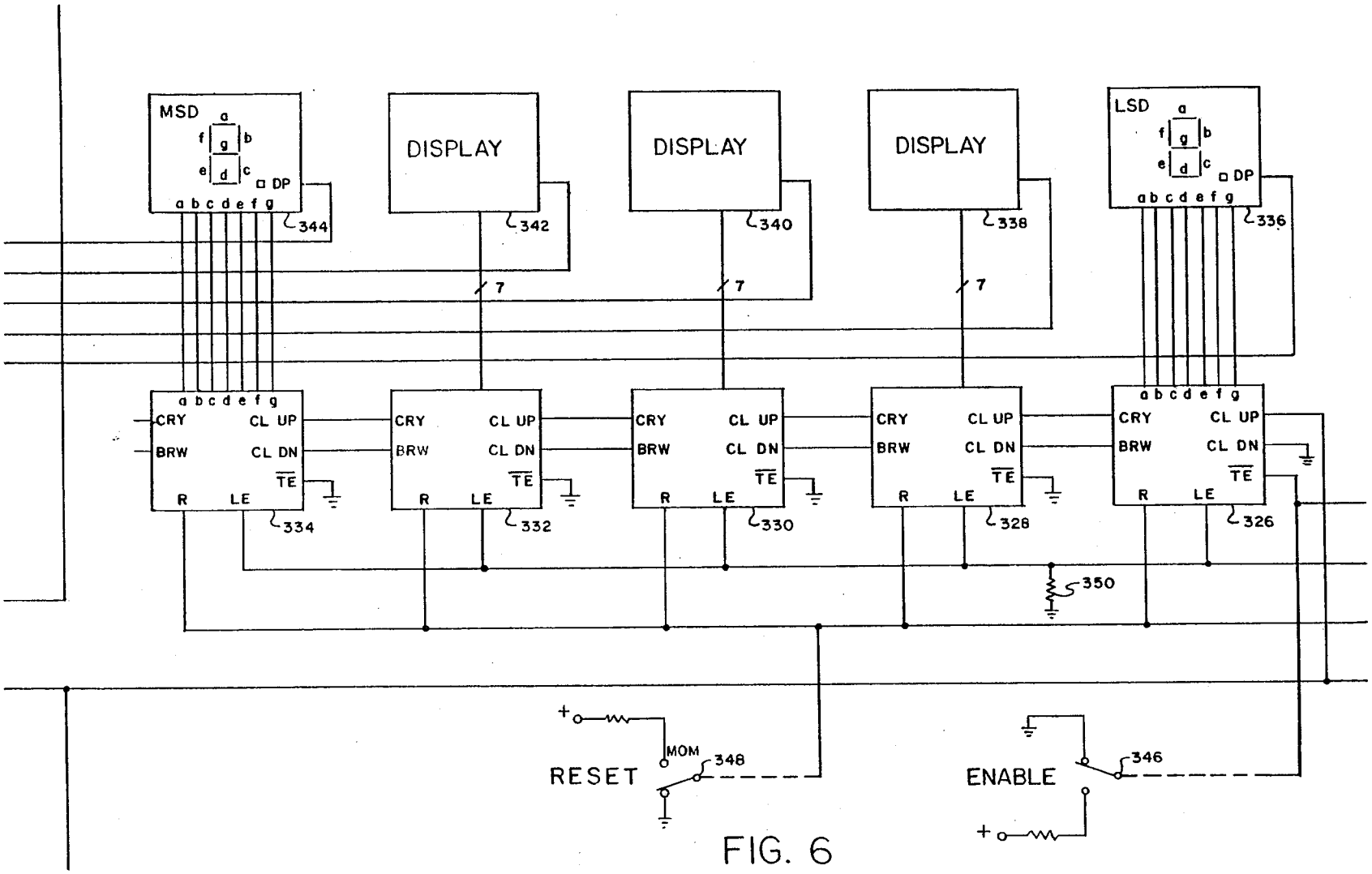

In order to permit the operator to control the speed at which record 24 advances, a chart speed switch 94 is provided and whose output supplies the data input of binary counter 294. The output of counter 294 is supplied to the comparator B input of phase lock loop 298. The jumper point 302, when connected as shown in FIG. 5A, supplies the comparator A input of phase lock loop 298. The VCO output of phase lockloop 298 is supplied to the clock input of counter 294 and to the clock input of counter divider 300, which is arranged to divide by one hundred. The output of counter 300 is supplied to the on input of chart drive switch 306. The chart drive ON/OFF switch provides a means of disabling the record drive signal hence the advancement of record 24. The output of switch 306 is supplied to the fast forward switch 98.

The fast forward switch 98 provides a means of advancing the record at two speeds. The first speed is used for fine positioning of the record and occurs when fast forward switch 98 is depressed, after approximately three seconds the speed is increased. This second speed provides rapid advancement of the record. The fast forward switch 98 has two poles, one of which the output is supplied through a differentiation network including the series capacitor 308 and the shunt resistor 310 to the parallel enable input of counter 304. When switch 98 is activated counter 304 is loaded with a count of fifteen and the zero output is cleared. The zero output is supplied to the clock inhibit input of counter 304, to a input of inverter 314, and to a input of the nand-gate 320, thus enabling counter 304 to count down. The output of inverter 314 is supplied to a input of nand-gate 318. The Q11 output of counter 292 is supplied to a input of nand-gate 318, the output of which is supplied to a input of or-gate 322, whose output is supplied to the momentary contact of the fast forward switch 98. When counter 304 reaches the zero count a zero output occurs, which inhibits counter 304 and nand-gate 318, and enables nand-gate 320. The Q8 output of counter 292 is supplied to a input of nand-gate 320, whose output is supplied to a input of nand-gate 322, thus shifting from the first speed to the second speed of record advance. The second speed output is maintained as long as the fast forward switch is depressed, upon release the cycle is repeated.

The output of fast forward switch 98 is supplied to the toggle input of stepper motor drive 324, which supplies the required sequence of drive signals to stepper motor 28. The output of direction switch 312 is supplied to the rotation input of driver 324, which provides clockwise or counter clockwise rotation of stepper motor 28, hence forward or reverse advance of record 24.

Figures 2, 2A:
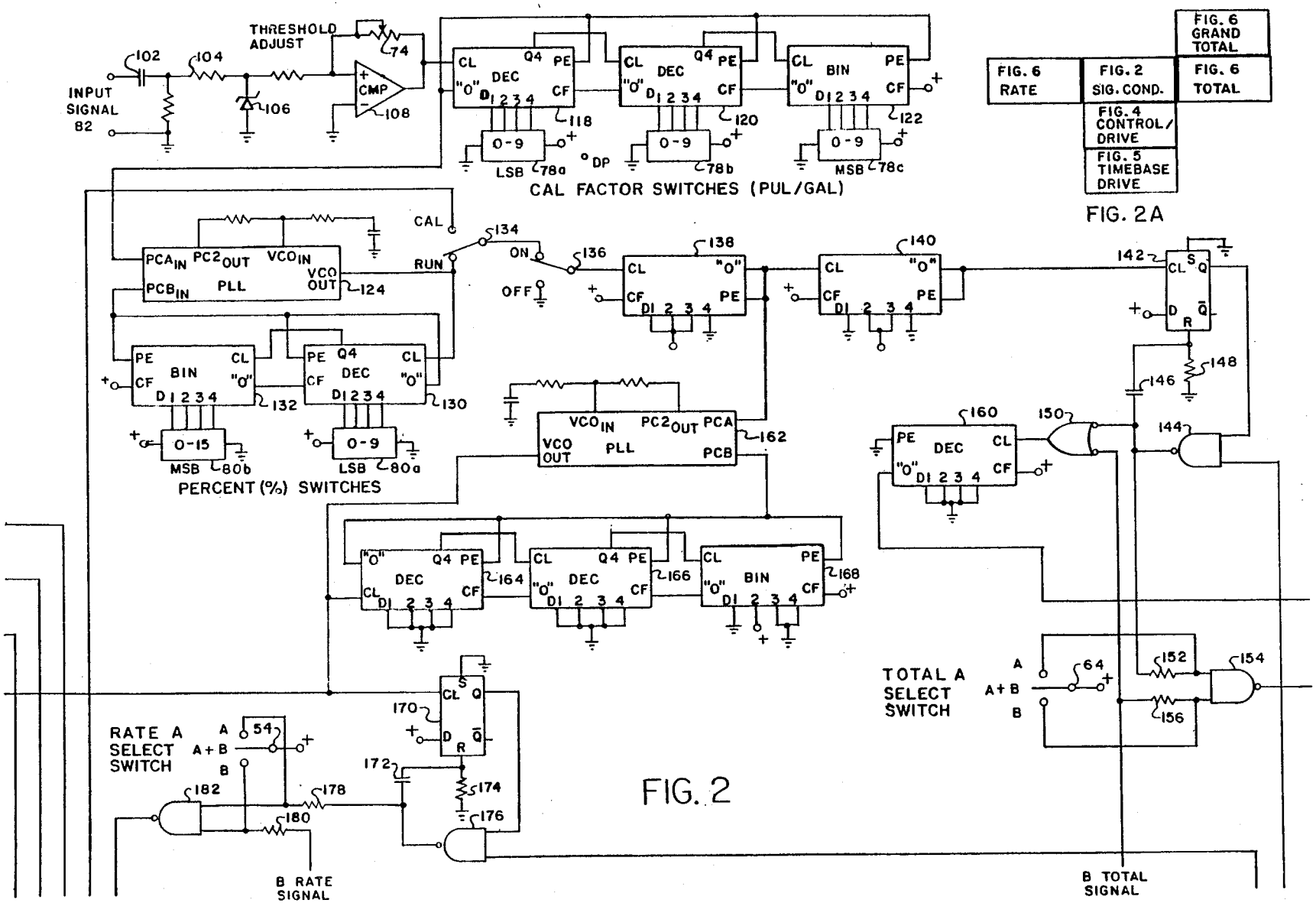
FIG. 2 is a schematic diagram of typical logic circuitry that may be used to perform the function of prescaling /scaling of frequency signal inputs of the apparatus of FIG. 1.
Figures 3, 3A:
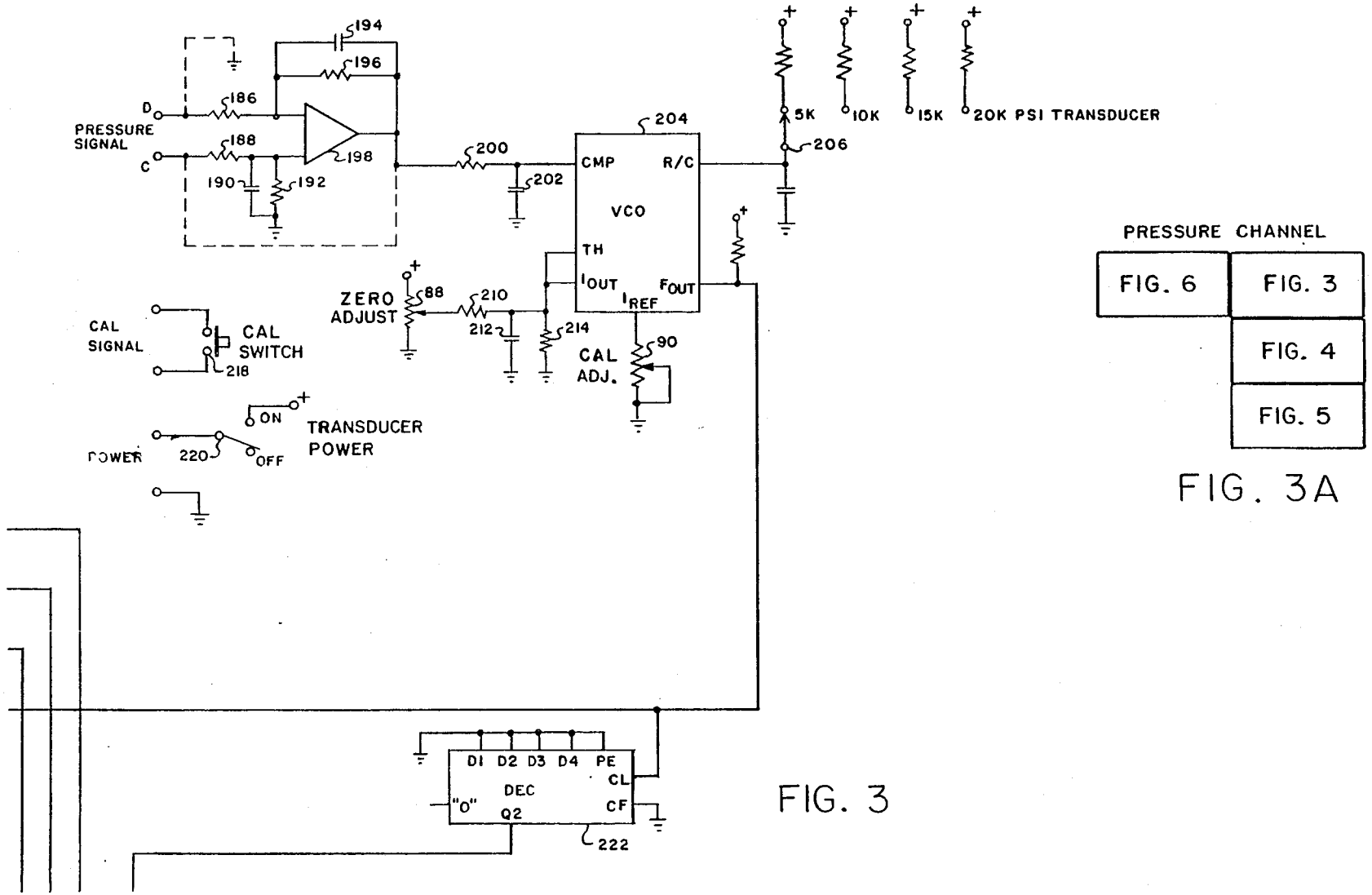

Considering now the remaining portions of the monitor apparatus of the present invention, in order to provide a simple and economical display which can be employed to display the parameters, a five decade display arrangement is employed and the function of which is determined by the signal source as shown in FIGS. 2A and 3A. The display arrangement is comprised of five up/down counters/latches/decoders/-drivers 326, 328, 330, 332, and 334 whose outputs are supplied to the input of 7-segment displays 336, 338, 340, 342, and 344. The clock, latch enable, and reset inputs are controlled by one of two sources, depending on the parameter being displayed; first if the display parameter is pressure, rate, density, rpm, or concentration then the gate 240, strobe 242, and reset 244 signals provide control respectively; second if the parameters being displayed are totals or volume then enable switch 346, resistor 350, and reset switch 348 provide control respectively. When pressure, rate, density, rpm, or concentration is being displayed the operation is automatic, if however, totals or volumes are being displayed the operator has a requirement to manually control the display. The enable switch 346 controls the enable input of counter 326, the latch enable is disabled by grounding through resistor 350, and the reset switch 348 provides clearing the display to zero.

While the arrangement described above is the preferred embodiment of the invention, it may be modified employing two digital-to-analog converters; one controlled by the output of latch 230; and the second controlled by the output of counter 234. The output of these two digital-to-analog converters may then be supplied to a analog comparator to produce a comparison of the digital values and the output of the comparator then being supplied as one input of the exclusive or-gate 248. In addition it may be modified by employing a microprocessor to emulate the preferred embodiments including prescaling 72 and 84, scaling 52 and 62, marker control 42, stepper motor control 36, and recond control 96, the functions and controls thereof provided to form a oilfield monitor and recorder of the present invention. Also, while there have been illustrated and described various embodiments of the present invention, it will be apparent that various changes and modifications thereof will occur to those skilled in the art. It is intended in the appended claims to cover all such changes and modifications as fall within the true spirit and scope of the present invention.

What is claimed is:

1. A system for oilfield monitoring and recording of parameters, comprising:

transducer means, for generation of a signal proportional to a measured parameter;

prescaling means, for developing a rate signal proportional to the measured parameter of said transducer means at any given instant;

first counter means, controlled by a control pulse means and operative to count said rate signal, thereby providing an indication of the measured parameter;

scaling means, for operating upon said rate signal, provide means for summing a plurality of said rate signals;

second counter means, controlled by said control pulse means, operative to count said summed rate signal;

third counter means, controlled by said control pulse means, operative to count an accumulated total amount of said summed rate signals;

marker control drive means, having an input to which said rate signal is supplied, having a second input to which a marker position signal is supplied;

comparison means, to determine equality, operative means to drive said marker position signal to establish equality with said rate signal;

marking means, to provide a record indicative of the measured parameter of said transducer means;

advance means, provides a time-record relationship for said record; and control means, for advancement of said record, whose input signal is supplied by said control pulse means.

2. The system of clain 1 further including:

converter means, for converting an analog signal to said rate signal and proportional to the measured parameter of said transducer means;

zero potentiometer means, for zeroing said rate signal; and calibration potentiometer means, for calibrating said rate signal.

3. The system of claim 1 further including:

detector means, for detecting a rate signal proportional to the measured parameter of said transducer means;

threshold means, for providing a variable hysteresis, which provides maximum noise immunity;

scaling input means, which provides a calibration means of said rate signal; and percent input means, which provides a multiplication means of said rate signal.

4. The system of claim 1, which further includes a control means for the selection of a number of said rate signals for supply to said third counter means to provide said indication of said accumulated total amounts.

5. The system of claim 1, which further includes a marker control means for providing a summed rate signal to said input of said marker control drive means.

6. The system of claim 1, which further includes:

leadscrew means, for mechanical positioning;

stepper motor means, for electromechanical drive; and position sensor means, for sensing said marker position, for generation of said marker position signal.

7. The system of claim 1, which further includes:

first control means, for setting a reference zero position of said marker means;

second control means, for setting a full scale span position of said marker means;

third control means, for control of rate-of-movement of said marker means to provide a dampening effect;

fourth control means, for selection of a number of calibrated full scale ranges without adjustment of said second control means; and fifth control means, a switch to select said zero position to be at either side of said record.

8. The system of claim 1, wherein said advance means further includes:

stepper motor means;

motor control/drive means; and tractor drive means, for advancement of said record.

9. The system of claim 8, wherein said motor control/drive means further includes:

calibrated speed control means, for said record advancement; and fast forward control means, which provides two speeds, a first speed for fine positioning of said record, a second speed for rapid advancement of said record.

10. In a system for oilfield monitoring and recording of parameters, the combination of, a transducer unit means, means in said unit for generation of a signal proportional to a measured parameter, a prescaling means for developing a digital signal proportional to the measured parameter of said transducer unit means at any instant, means for an output to provide an indication of the measured parameter, a scaling means for operating upon said digital signal and summing a plurality of said digital signals, an output means to provide an indication of an accumulated total amount of said summed digital signal and a control means thereof, a marker control drive means having an input to which said digital signal is supplied and having a second input to which a marker position signal is supplied, a comparison means to drive the marker position signal to establish equality with said digital signal, a marker means attached thereof to provide a record indicative of the measured parameter of said transducer unit means, an advancement means provides a time record relationship for said record means for advancement of said record means, a control means operative in response to said input signals, providing the necessary calculations for said scaling and providing a output signal for said indication means and said record in rapid succession so as to appear instantaneous.

11. A system for oilfield monitoring and recording of parameters comprising:

transducer unit means, for generation of a signal proportional to a measured parameter;

prescaling means, for developing a rate signal proportional to the measured parameter of said transducer unit means at any instant;

first counter means, controlled by a control pulse means, operative to count said rate signal;

indicator means, for providing an indication of the measured parameter;

scaling means, for operating upon said rate signal, provides means for summing a plurality of said rate signal;

second counter means, controlled by said control pulse means, operative to count a accumulated total amount of said summed rate signal;

marker control drive means, having an input to which said rate signal is supplied;

rate to analog converter means, for developing a analog signal;

analog comparator means, first input being said analog signal, a second input to which a marker position signal is supplied, a comparison means to determine equality;

electromechanical means, to drive the marker position signal to establish equality with said analog signal;

marker means, attached thereof to provide a record indicative of the measured parameter of said transducer unit means; and advancement means, provides a time record relationship for said record.

12. The system of claim 11, wherein said scaling means further includes:

analog signal means, to accept a analog signal;

rate signal means, to accept a rate signal;

digital signal means, to accept a digital signal;

prescale means; and percent multiply means, to provide a calibrated output signal.

13. The system of claim 12 further includes means to scale and sum said calibrated output signal for application to an indicator means.

14. The system of claim 11 further includes means to scale and control said calibrated output signal for application to said electromechanical means for generation of said record of the measured parameters.

15. The system of claim 14, which further includes:

leadscrew means;

stepper motor means, to mechanically position said marker means; and position sensor means, for generation of said record.

16. The system of claim 11, wherein said advancement means further includes:

tractor drive means;

stepper motor means;

control means, for said record advancement means;

calibrated speed control means; and fast advance switch means, for advancement of said record at two speeds, a first speed for fine position of said record, a second speed for rapid advance of said record.

* * * * *